US007328644B2

(12) United States Patent
Vickroy

(10) Patent No.: US 7,328,644 B2
(45) Date of Patent: Feb. 12, 2008

(54) SYSTEM AND METHOD FOR INTERCEPTING A PROJECTILE

(75) Inventor: Samuel C. Vickroy, Madison, AL (US)

(73) Assignee: SCV Quality Solutions, LLC, Madison, AL (US)

( * ) Notice: Subject to any disclaimer, the term of this patent is extended or adjusted under 35 U.S.C. 154(b) by 0 days.

(21) Appl. No.: 11/179,152

(22) Filed: Jul. 12, 2005

(65) Prior Publication Data

US 2007/0169616 A1 Jul. 26, 2007

(51) Int. Cl.
*B64D 1/04* (2006.01)

(52) U.S. Cl. ..... 89/1.11; 89/1.34; 102/405

(58) Field of Classification Search ..... 102/303, 102/502, 504, 405; 109/49.5; 89/1.11, 1.34
See application file for complete search history.

(56) References Cited

U.S. PATENT DOCUMENTS 4,386,355 A 5/1983 Drew et al.
4,912,869 A 4/1990 Govett
5,437,230 A * 8/1995 Harris et al. ..... 102/302
5,583,311 A * 12/1996 Rieger ..... 89/1.11
5,750,918 A * 5/1998 Mangolds et al. ..... 102/502
5,880,693 A 3/1999 Drummer
6,455,828 B1 9/2002 Gauggel et al.
6,626,077 B1 * 9/2003 Gilbert ..... 89/1.11
6,825,792 B1 11/2004 Letovsky
6,854,374 B1 2/2005 Breazeale
6,904,838 B1 * 6/2005 Dindl ..... 89/1.1
6,957,602 B1 * 10/2005 Koenig et al. ..... 89/1.11
2006/0169832 A1 * 8/2006 Glasson ..... 244/3.1

* cited by examiner

*Primary Examiner*—Michael J. Carone
*Assistant Examiner*—Benjamin P Lee
(74) *Attorney, Agent, or Firm*—Lanier Ford Shaver & Payne P.C.; Ann I. Dennen

(57) ABSTRACT

A system has a containment blanket. The system further has a launcher configured to launch the containment blanket and logic configured to deploy the containment blanket. The containment blanket is configured to encompass an incoming projectile.

16 Claims, 14 Drawing Sheets

SYSTEM AND METHOD FOR INTERCEPTING A PROJECTILE

RELATED ART

There are systems in use or in development for intercepting intercontinental ballistic missiles (ICBMs), shoulder-launched rockets, and/or rocket-propelled grenades (RPGs). Such systems are now described with reference to FIG. 1A-FIG. 1C.

Generally, FIG. 1A illustrates a ground-based launch site 102 situated on the earth's surface 122 from which a missile 104 is launched. There are a variety of ways known in the art for detecting the incoming missile. For example, FIG. 1A further illustrates a satellite 108, an early warning system 132, and a command, control, and communications (CCC) base 141.

The satellite 108 may detect the launch of the missile 104 from the launch site 102. Further, the early warning system 132 may detect, via radar, the missile 104. The satellite 108 and the early warning system 132 then transmits data to the CCC base 141 indicative of the location of the launch, the velocity of the missile, and other data indicative of the trajectory of the launched missile.

The CCC base 141 receives such data and determines a launch position and/or other trajectory characteristics necessary for a kill vehicle 121, e.g., a missile, to intercept the missile 104. The CCC base 141 then launches a missile 121 for intercepting the missile 104. Such a described system is typical for exo-atmospheric missiles, such as, for example, ICBMs.

FIG. 1B illustrates a ground-based launch site 108 situated on the earth's surface 122 from which a missile 103, e.g., a scud missile, is launched. There are a variety of ways known in the art for detecting such an incoming missile 103. For example, an missile defense system that is entitled Terminal High Altitude Area Defense (THAAD—formerly "Theater High Altitude Area Defense") is a United States Army project aimed theater threats. THAAD comprises a THAAD launch vehicle 112, which uses information from an early warning system 110 to detect the incoming missile 103. Once detected, the vehicle 112 launches an interceptor missile 150 that seeks and destroys the incoming missile 103. However, the THAAD system leaves a debris field 118 on the earth's surface 122 risking property and life.

Another anti-ballistic system is PATRIOT, which is a system designed to counter tactical ballistic missiles, cruise missiles, and advanced aircraft. The PATRIOT anti-ballistic missile system also uses the early warning system 110. The early warning system 110 finds, identifies, and tracks the incoming missile 103. A PATRIOT battery 114 then launches a missile 115 that intercepts and destroys the incoming missile 103. Much like the THAAD system, the PATRIOT system also creates a debris field 120 on the earth's surface 122 in conjunction with a successful interception of the incoming missile 103.

FIG. 1B further illustrates a system that is currently being developed and/or tested that employs airplane 106, the Boeing 747, and a high-powered laser 133 for missile defense. In this regard, the airplane 106 is equipped with an array of sensors (not shown) that is capable of detecting a missile launch. Once the launch is detected, data defining the launch is used to track the launched missile 103 to determine three-dimensional coordinates defining the launch site, the location of the launched missile 104, and/or the predicted location of the launched missile 103. The on-board laser 133 is primed and activated emitting laser beam 116, and the laser beam 116 destroys the launched missile 104. However, after the missile 104 is destroyed, debris will fall to the earth's surface 122 landing in an area referred to as a debris field 122, thereby risking damage to property located within the debris field, as well as death and/or bodily injury to individuals in the debris field 110.

FIG. 1C depicts a ground-based launch site 115 situated on the earth's surface 122 from which a missile 113, e.g., an RPG or shoulder-fired missile, is launched. There are a variety of ways known in the art for intercepting the incoming mortar 113. For example, FIG. 1C further illustrates a Counter Rocket, Artillery, and Mortar (C-RAM) system 125. The C-RAM system 125 receives data from an early warning system 124. The C-RAM system 125 then launches a projectile 126 at the incoming mortar 113. However, upon interception, the intercepted mortar 113 generates a debris field 181.

FIG. 1C further illustrates "Vigilant Eagle" which is a system currently in development. The Vigilant Eagle is installed at an airport 144 and comprises distributed infrared sensors 145 for detecting an incoming missile and a high-power amplifier-transmitter (HAT) 143, which comprises highly efficient antennas linked to solid state amplifiers. The HAT 143 radiates a tailored electromagnetic waveform 142 to deflect it away from the airport. However, presently there is no solution for interception of the deflected missile 113.

Each system described hereinabove is costly to design, construct, and operate in addition to the debris field risks described herein. Thus, systems that are not as costly to design, that can use existing detection and tracking technology, and that eliminate potential debris fields are generally desirable.

SUMMARY OF THE DISCLOSURE

Generally, the present disclosure provides systems and methods for intercepting an incoming missile, enveloping the missile, and depositing the enveloped missile on the earth's surface.

A system in accordance with an embodiment of the present disclosure comprises a tube, and the tube has a containment blanket. The system further has a launcher configured to launch the tube and logic configured to deploy the containment blanket. The containment blanket is configured to encompass an incoming projectile.

A method in accordance with an embodiment of the present disclosure comprises the steps launching a containment blanket toward a projectile and encompassing the incoming projectile in the blanket.

BRIEF DESCRIPTION OF THE DRAWINGS

The disclosure can be better understood with reference to the following drawings. The elements of the drawings are not necessarily to scale relative to each other, emphasis instead being placed upon clearly illustrating the principles of the disclosure. Furthermore, like reference numerals designate corresponding parts throughout the several views.

DETAILED DESCRIPTION

Embodiments of the present disclosure generally pertain to systems and methods for intercepting projectiles, e.g., mortar rounds and missiles. A projectile interception system in accordance with at least one embodiment of the present disclosure contains debris from an intercepted missile in order to reduce the risks associated with the debris falling to earth.

In this regard, when a projectile is fired, the system detects the incoming projectile and launches a containing blanket. The containing blanket is fired in a direction and at a velocity to intercept the projectile. Furthermore, upon striking the projectile, the blanket envelops the projectile and activates a collapsible device that retards descent of the contained projectile.

An exemplary embodiment of the present disclosure is now described with reference to FIGS. 2-7. FIGS. 2-7 illustrate a sequential progression of the detection, interception, and containment of a projectile in accordance with an embodiment of the present disclosure.

Figure 1A:
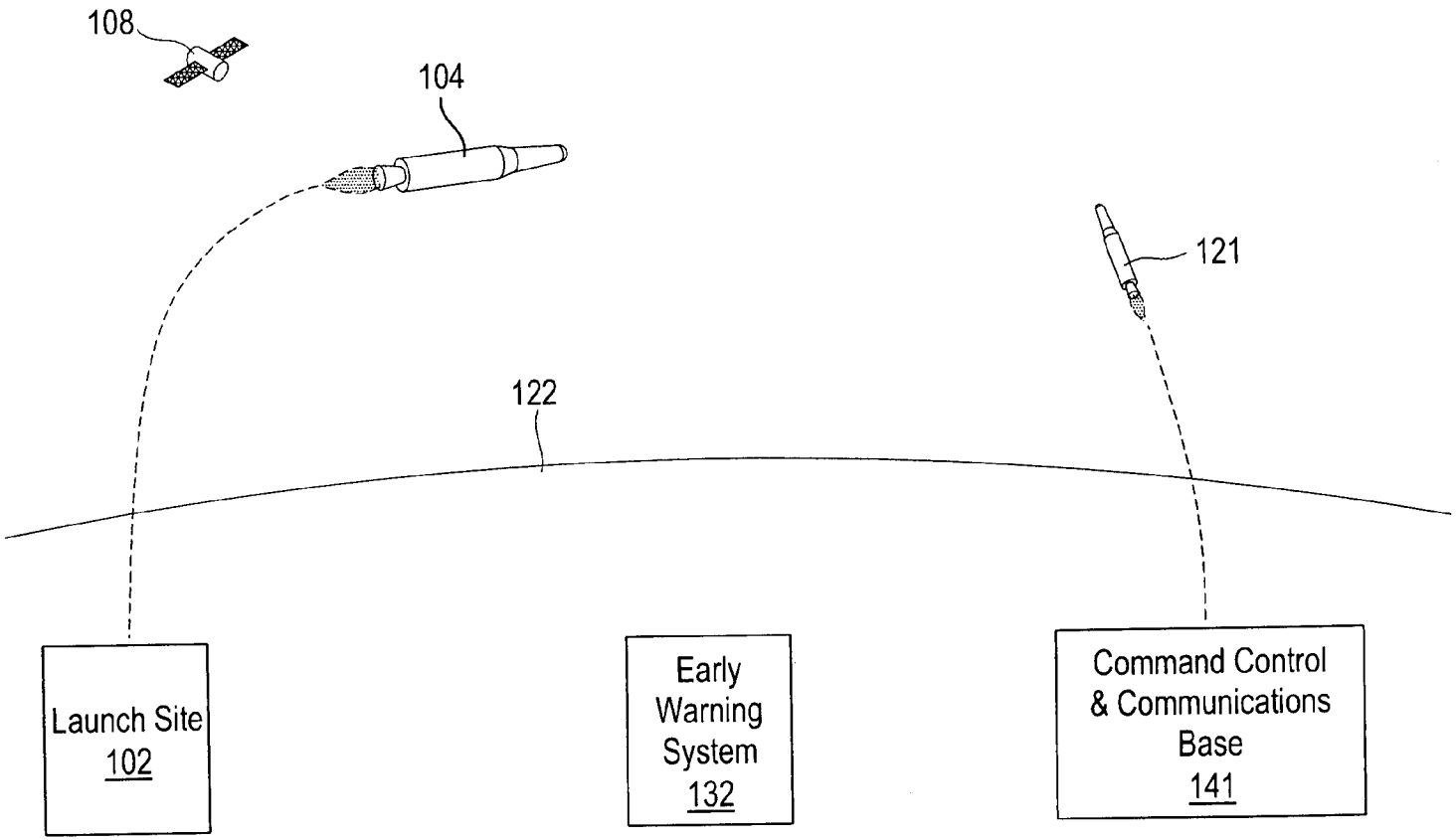
FIG. 1A Prior Art
FIG. 1 is a diagram illustrating a plurality of debris fields created by conventional anti-ballistic missile systems.
Figure 1B:
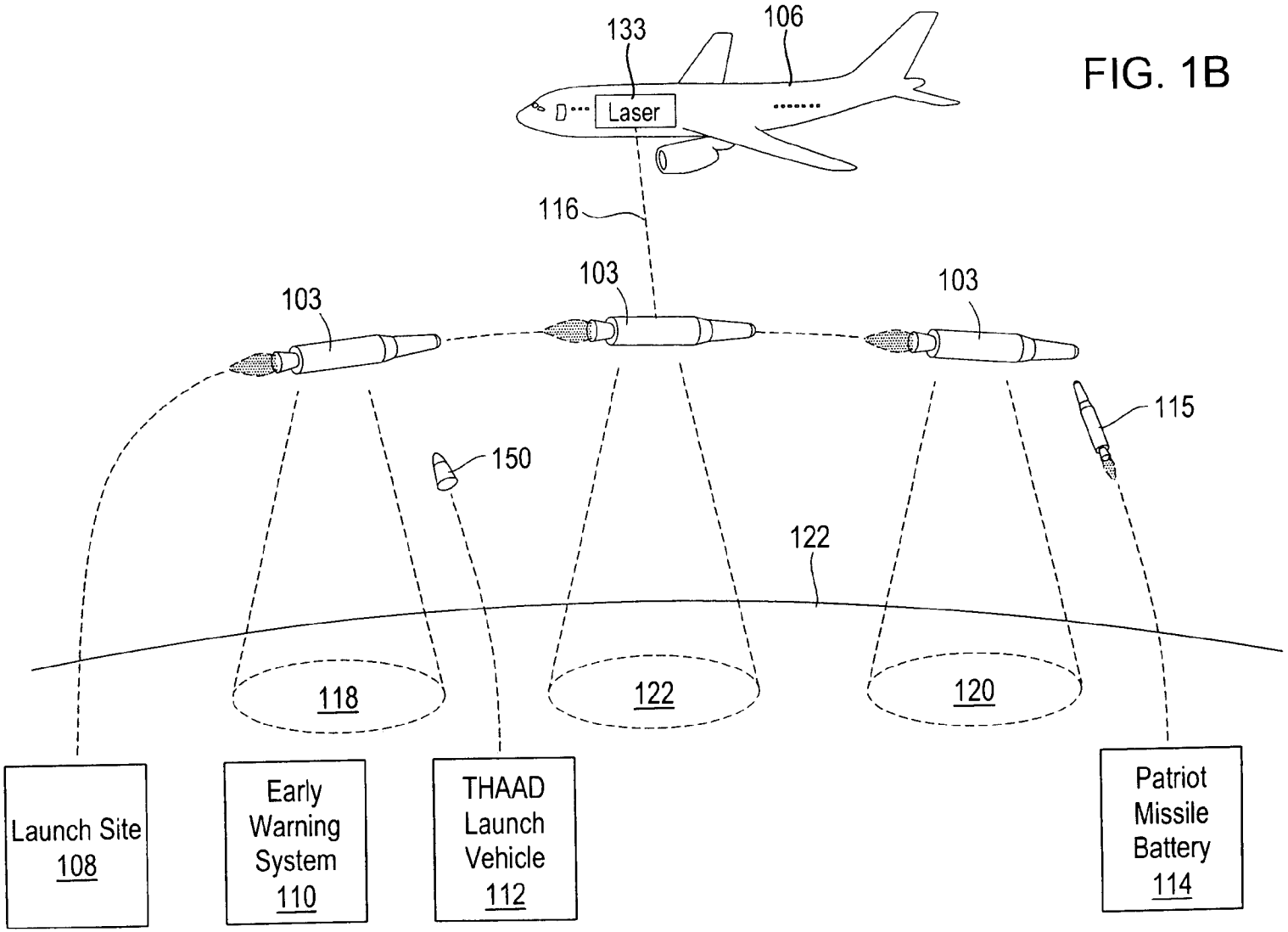
Figure 1C:
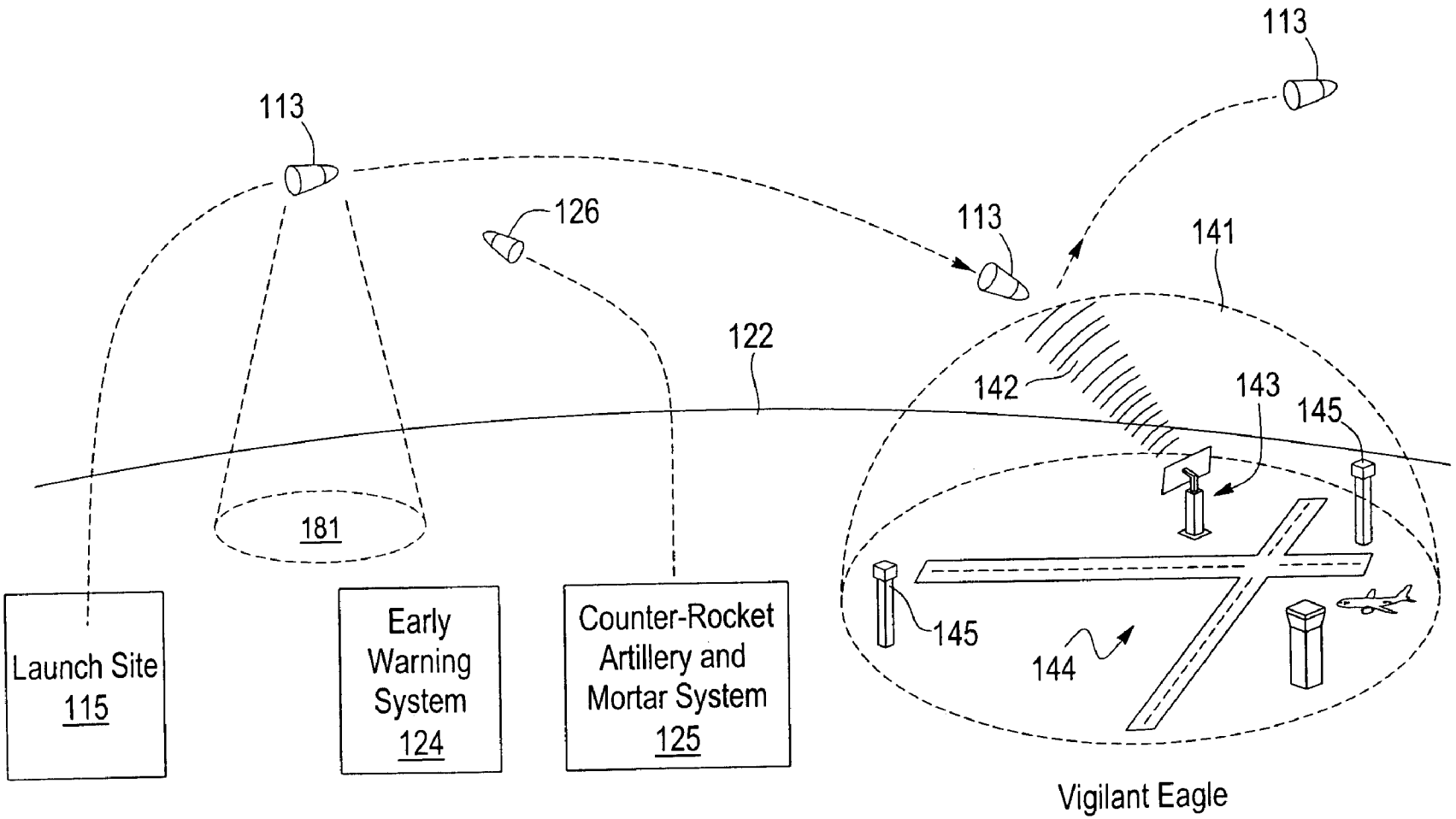
Figure 2:
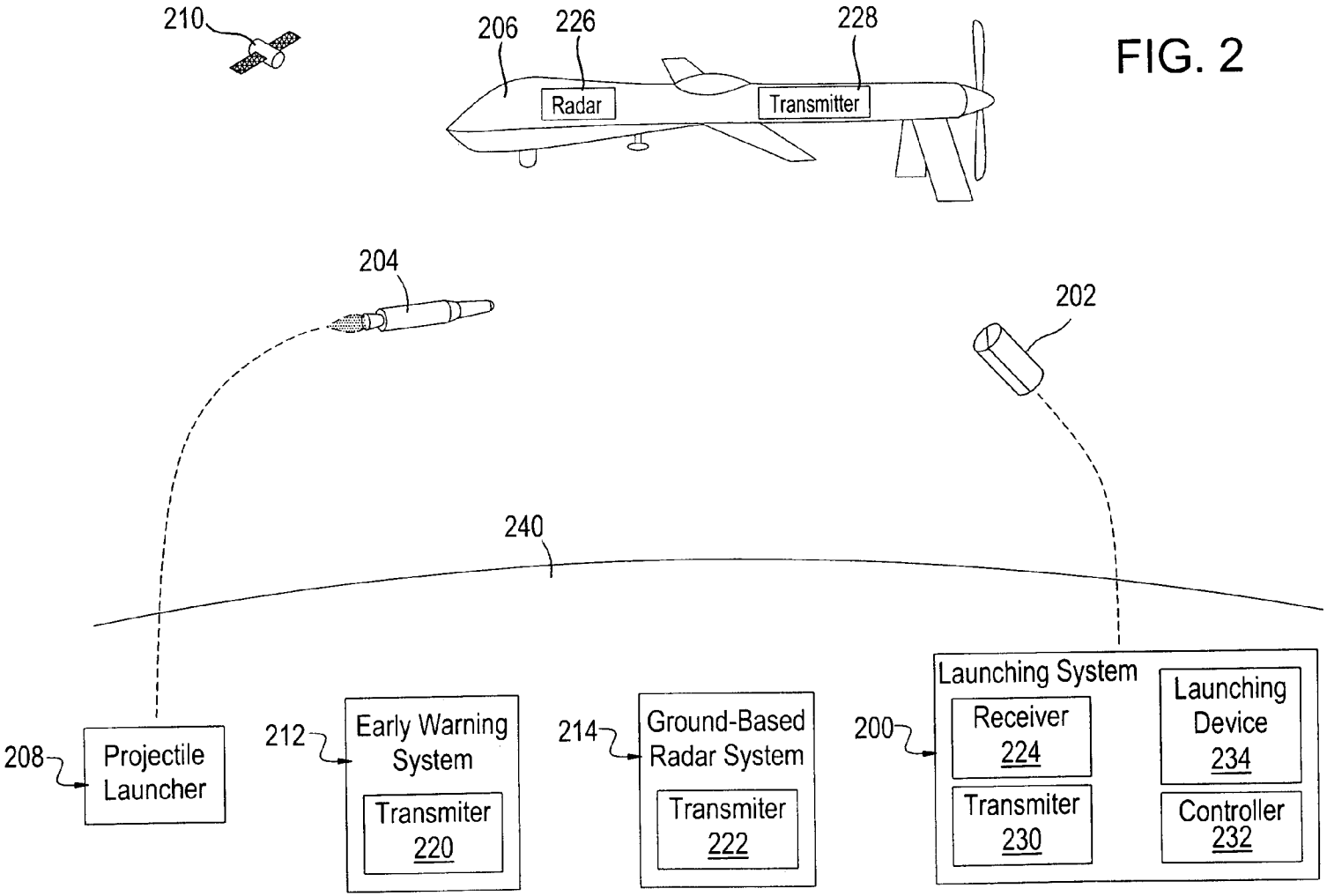
FIG. 2 is a diagram illustrating an exemplary embodiment of a projectile interceptor system of the present disclosure.

FIG. 2 depicts a projectile launcher 208 and an exemplary embodiment of a launching system 200 of the present disclosure. The projectile launcher 208 launches a projectile 204. Exemplary projectiles 204 may include a missile or a shoulder-launched rocket, e.g., a rocket-propelled grenade (RPG), a mortar, or other type of projectile. The launching system 200 intercepts the projectile 204 and places the projectile 204 on an earth's surface 240.

The launching system 200 comprises a launching device 234, a receiver 224, a transmitter 230, and a controller 232. The launching device 234 preferably comprises a battery (not shown) in which a plurality of aerial tubes 202 are housed and ready for launch upon detection of the incoming projectile 204. The receiver 224 and the transmitter 230 may be configured for communications, for example, over a wireless connection, such as radio.

In one embodiment, a satellite 210 may detect the incoming projectile 204. Upon detection, the satellite 210 communicates data indicating detection of the projectile 204, and an early warning detection system 212 receives such data. Upon receipt, the early warning detection system 212 may notify the launching system 200 of the detection. In this regard, the early warning system 212 comprises a transmitter 220 that transmits data indicative of the location of the projectile launcher 208 or the predicted location of the projectile 204 to the receiver 224 of the launching system 200.

Such data, hereinafter referred to as "projectile data," may include three-dimensional coordinates, such as x-, y-, and z-coordinates, and other information for identifying the location of the incoming projectile 204. Note that various known or future-developed early warning detection systems may be used to implement the early warning system 212 of the present disclosure.

In another embodiment, a ground-based radar system 214 may be used to detect and track the incoming projectile 204. The ground-based radar system 214 comprises a transmitter 222 that transmits projectile data to the receiver 224 of the launching system 200 when a projectile 204 is detected. Note that various known or future-developed ground-based radar systems may be used to implement the ground-based radar system 214 of the present disclosure.

In another embodiment, an airplane 206, such as a drone, may comprise an aerial radar system 226. Like the ground-based radar system 214, the aerial radar system 226 detects the incoming projectile 204, and a transmitter 228 transmits projectile data to the receiver 224 of the launching system 200 corresponding to the projectile detected by the radar 226. Note that various known or future-developed ground-based radar systems may be used to implement the ground-based radar system 214 of the present disclosure.

Note that the early warning system 212 and the ground-based radar system 214 are provided as merely examples of detection systems that can be used in the implementation of the present disclosure. Other exemplary detection systems may include acoustic detection devices, infrared detection devices, or other known or future-developed devices capable of detecting an incoming projectile 204.

Furthermore, note that the early warning system 212, the ground-based radar system 214, the aerial radar system 226, or any other type of detection system utilized in detecting and/or tracking the incoming projectile 204 can communicate with the receiver 224 of the launching system 200 using any suitable technologies known in the art. For example, the projectile data may be transmitted to the launching system 200 via a wireless connection between the transmitters 220, 222, or 228 and a receiver 224 of the launching system 200.

Upon receipt of the projectile data, via the receiver 224, from the early warning system 212, the ground-based radar system 214, the aerial radar system 226, or any other detection and/or tracking system known in the art, the launching system controller 232 of the launching system 200 launches at least one aerial tube 202 from the launching device 234.

In one embodiment, the controller 232 remotely controls interception of the tube 202 with the projectile 204, which will be described further herein. In another embodiment, the controller 232 calculates data for controlling the tube 202, and provides such data to the tube 202 prior to launch, which will be described further herein.

The launching system controller 232 can be implemented in software, hardware, or any combination thereof. Note that the launching system controller 232, when implemented in software, can be stored and transported on any computer-readable medium for use by or in connection with an instruction execution system, such as a computer-based system, processor-containing system, or other system that can fetch the instructions from the instruction execution system and execute the instructions. In the context of this document, a "computer-readable medium" can be any means that can contain, store, communicate, propagate, or transport the program for use by or in connection with the instruction execution system. Note that the computer-readable medium could even be paper or another suitable medium upon which the program is printed, as the program can be electronically captured, via for instance optical scanning of the paper or other medium, then compiled, interpreted or otherwise processed in a suitable manner if necessary, and then stored in a computer memory. As an example, the controller 232 may be magnetically stored and transported on a conventional portable computer diskette or compact disk read-only memory (CDROM).

The launching system controller 232 preferably comprises one or more processors (not shown), such as a digital signal processor (DSP) or a central processing unit (CPU), for example, that communicate to and drive the other elements within the launching system controller 232.

Furthermore, launching system controller 232 is communicatively coupled to the receiver 224 (FIG. 2) and the transmitter 230 (FIG. 2). Additionally, the launching system controller 232 is communicatively coupled to the launching device 234 for initiating a launch based upon received projectile data.

During operation, the launching system controller 232 preferably listens via the receiver 224 for receipt of data indicative of a detection, i.e., receipt of projectile data as described hereinabove. If projectile data is received via the receiver 224, the launching system controller 232 launches a tube at a time and in a direction corresponding to the projectile data received.

In this regard, the launching system controller 232 may calculate a launch time for launching a tube 202 (FIG. 3) based upon the projectile data, then launch the tube 202 according to the calculated time. The launch time calculated is such that the tube 202 will detonate prior to interception of the incoming projectile 204.

Furthermore, as described herein, the launching system controller 232 may calculate other control values associated with the tube 202 and the interception of the projectile 204. In this regard, the launching system controller 232 may transmit such values to the tube 202 prior to its launch, and a controller on the tube can use such values to control interception and containment of the projectile 204. Alternatively, the launching system controller 232 may use such values to control interception and containment by the tube 202 of the projectile 204 remotely. Each of these embodiments is described further herein with reference to FIG. 10.

Figure 3:
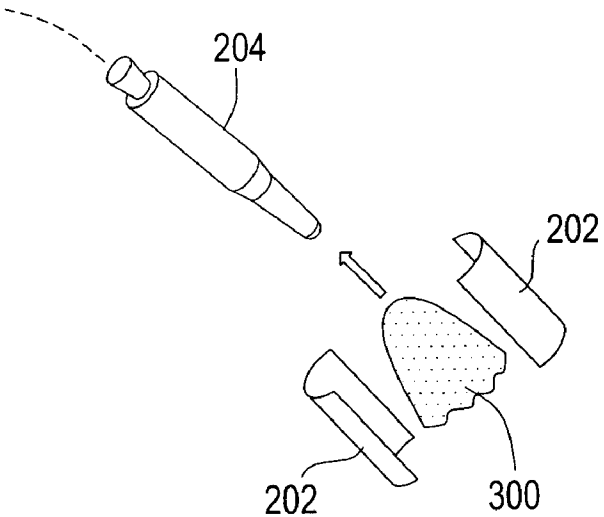
FIG. 3 illustrates detonation of an aerial tube and release of a containment blanket launched from the projectile interceptor system of FIG. 2.

FIG. 3 depicts a containing blanket 300 that is released upon separation of the tube 202. The tube 202 can be separated in any number of ways including detonation via an explosive device or by release of fasteners holding portions of the tube 202 together. After separation, portions of the tube 202 may fall to the earth's surface 240 (FIG. 2).

The containing blanket 300 is released upon separation of the tube 202 and travels in a direction of the incoming projectile 204. Such travel may be effectuated by inherent inertia of the containing blanket 300 from the launch of the tube 202 as the containing blanket 300 is released from the tube 202. Additionally, such travel may be effectuated by a propulsion device (not shown), e.g., a thruster, which is described in more detail herein. The inertia or the propulsion device propels the containing blanket 300 toward the projectile 204 along a path such that the containing blanket 300 intercepts the target.

In one exemplary embodiment, an internal timer (not shown) of the tube 202 may time such separation. In this regard, the launching system controller 232 may provide the tube 202 with value indicative of elapsed time or traveled distance. Thus, the launching system controller 232 launches the tube 202, and the tube 202 travels the predetermined distance or predetermined amount of time, and a tube controller separates the tube 202 based upon data provided by the launching system controller 232.

Alternatively, the launching system 200 may remotely activate separation of the tube 202. In this regard, the launching system controller 232 may determine the amount of time that is to pass before the launched tube 202 is at a location just prior to intercepting the projectile 204 and effective for separating the tube 202 to intercept the projectile 204. After such time has passed, the launching system controller 232 may transmit a signal via the transmitter 230 to the tube 202. Upon receipt of the signal, the tube 202 separates. As indicated hereinabove, the tube 202 is described further with reference to FIGS. 8-10.

Figure 4:
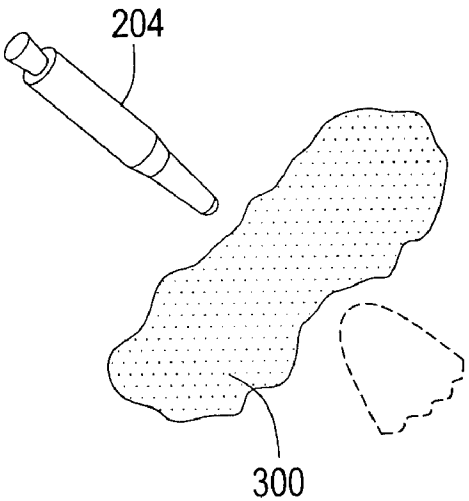
FIG. 4 illustrates deformation of the containment blanket as it travels toward the projectile launched from the projectile interceptor system of FIG. 2 in accordance with the present disclosure.

As the containing blanket 300 travels toward the projectile 204, it reshapes in a manner as indicated in FIG. 4. In this regard, the containing blanket 300 travels by inertia or propulsion in the direction toward the incoming projectile 204, and as it moves toward the projectile 204, it deforms in the manner indicated. The containing blanket 300 is described in more detail with reference to FIG. 10.

Figure 5:
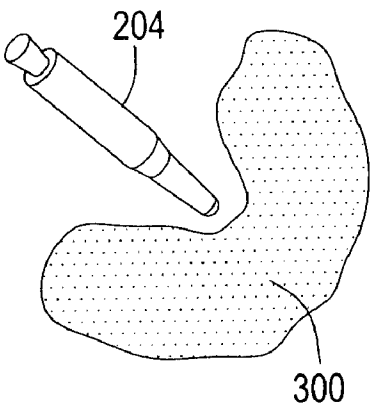
FIG. 5 illustrates further deformation of the containment blanket of as it travels toward the projectile launched from the projectile interceptor system of FIG. 2 in accordance with the present disclosure.

FIG. 5 further illustrates the containing blanket 300 as it moves toward the incoming projectile 204. As shown in FIG. 5, the containing blanket 300 travels toward the projectile 204 and deforms in such a way as to encompass the projectile 204. The deformation of the containing blanket 300 occurs as a result of the blanket's inertia and/or a propulsion device (not shown) in addition to drag on the blanket as a result of air. Furthermore, when the projectile 204 contacts the containing blanket 300, the force of the projectile 204 on the containing blanket 300 further causes the containing blanket 300 to envelop the projectile 204.

Note that the containing blanket 300 is shown as in direct alignment with the projectile 204 such that the projectile 204 contacts the containing blanket 300 at or close to the blanket's center. However, such alignment is unnecessary, and the projectile 204 may contact the containing blanket 300 off-center.

Figure 6:
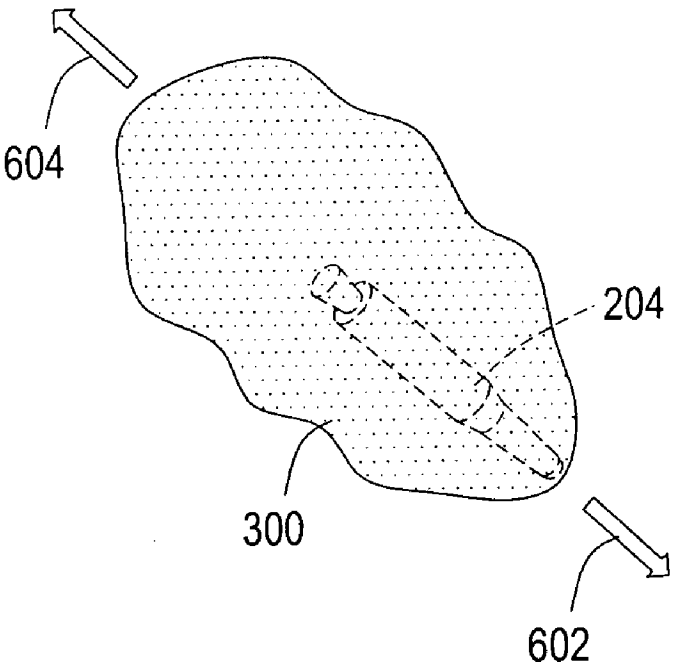
FIG. 6 illustrates envelopment of the projectile by the containment blanket launched from the projectile interceptor system of FIG. 2 in accordance with the present disclosure.

FIG. 6 illustrates the containing blanket 300 once it has encompassed the projectile 204. The projectile 204 is still travelling toward its intended destination in a direction indicated by a reference arrow 602. However, the containing blanket 300 is travelling in the direction indicated by the reference arrow 604. Notably, the containing blanket 300 travels at a velocity in the direction of reference arrow 604 such that the force of the blanket exerted on the projectile 204 is sufficient to overcome or at least decelerate the velocity of the projectile 204 in the direction of reference arrow 602.

Figure 7:
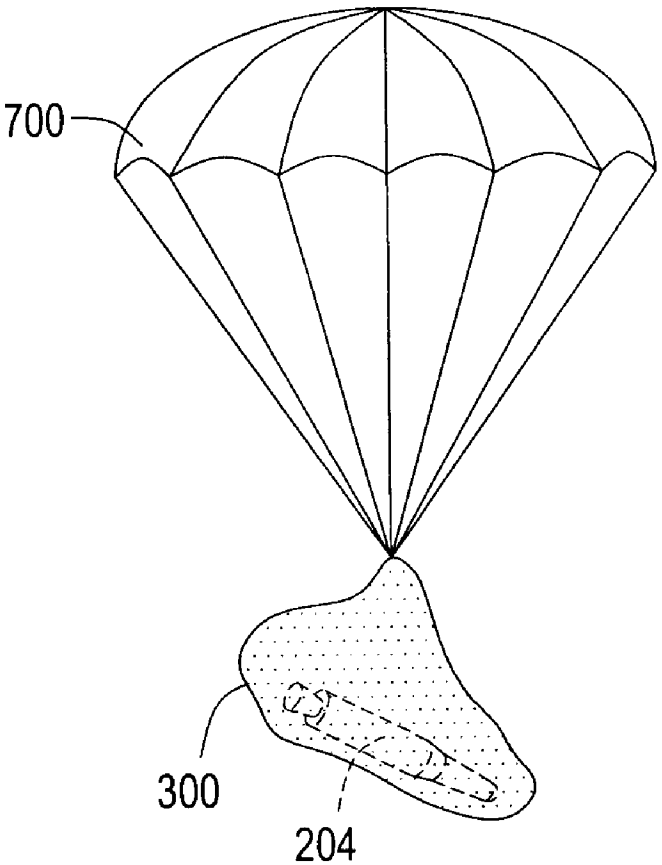
FIG. 7 illustrates descent of the containment blanket launched from the projectile interceptor system of FIG. 2 in accordance with the present disclosure.

With reference to FIG. 7, thruster control logic, described in more detail with reference to FIG. 10, determines that the projectile 204 is contacted. Based upon such determination, the control logic activates a parachute 700 that slowly carries the contained projectile 204 to the surface 240 (FIG. 2) of the earth.

Figure 8:
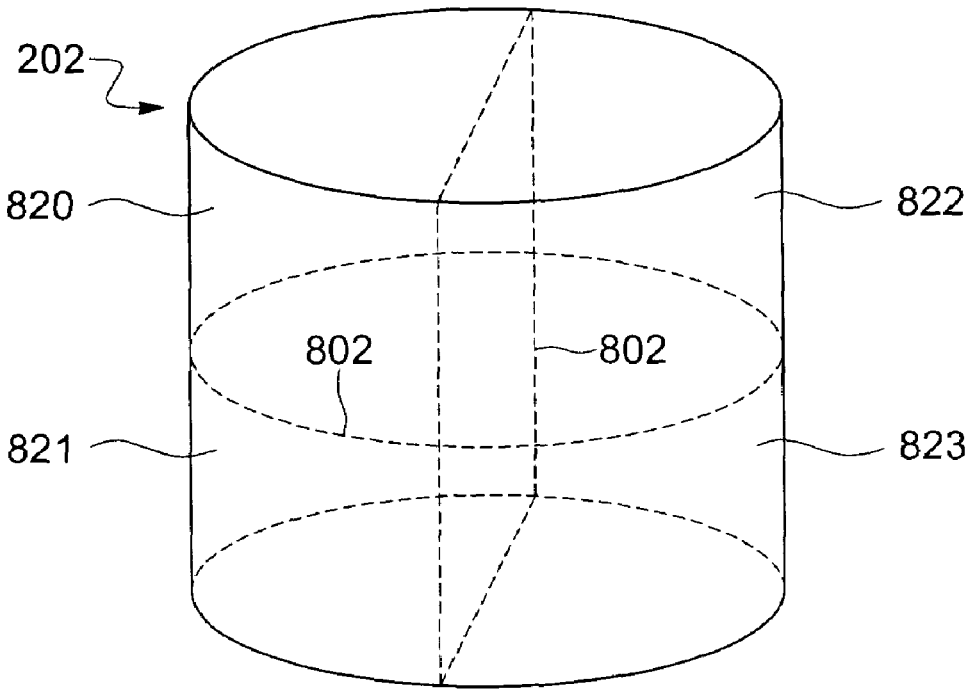
FIG. 8 is a perspective view of an exemplary tube depicted in FIG. 2 in accordance with an embodiment of the present disclosure.

An exemplary configuration of the tube 202 is now described in more detail with reference to FIGS. 8-10. With reference to FIG. 8, the tube 202 is preferably cylindrical as shown. However, other shapes are possible in other embodiments.

The tube 202 may be formed from a variety of materials, including metal, cardboard or paper, such as, for example like a firework tube. For example, the tube 202 may be formed of a lightweight metal, e.g., titanium. In one exemplary embodiment, the tube 202 has welded seams 802, as shown in FIG. 8. In this regard, contents (not shown) may be placed within the cylindrical tube 202, and the quarters 820-823 may be welded together to form a unitary tube 202.

The welded seams 802 provide mechanically weak lines in the cylindrical tube 202 so that the tube 202 may easily separate along those lines when desired. Such separation is described in more detail hereafter.

Figure 9:
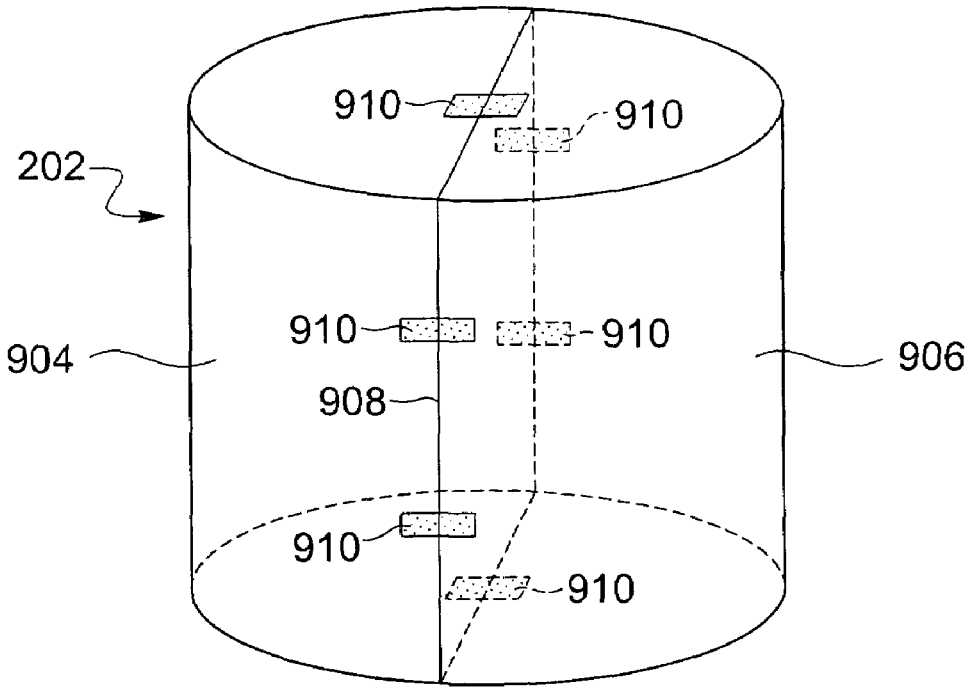
FIG. 9 is a perspective view of another exemplary tube depicted in FIG. 2 in accordance with an embodiment of the present disclosure.

Another embodiment of the tube 202 is illustrated in FIG. 9. FIG. 9 illustrates the tube 202 in a cylindrical shape, but other shapes are possible in other embodiments. The tube 202 of FIG. 9 comprises two halves 904 and 906. The halves 904 and 906 meet together at connection joint 908. The halves 904 and 906 may be fastened together at the joint 908 at fastening points 910 using metal releasable fasteners (not shown) and/or via welding.

The connection joint 908 provides a separation point in the cylindrical tube 202. In this regard, the tube 202 may easily separate along this line when separation is activated via, for example, detonation. Such detonation and separation is described in more detail hereafter.

Figure 10:
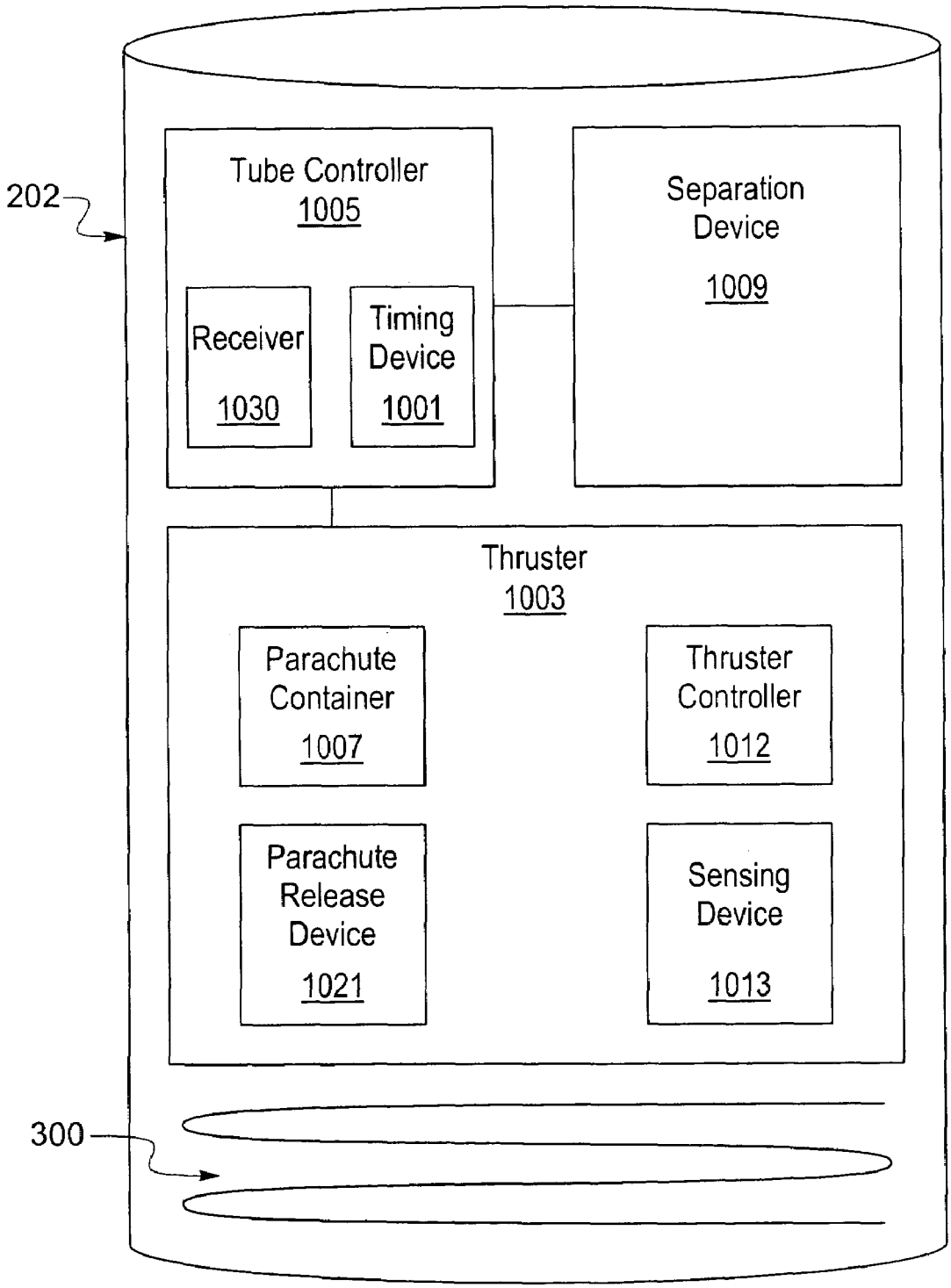
FIG. 10 is a block diagram depicting the contents of the tube of FIG. 2 in accordance with an embodiment of the present disclosure.

FIG. 10 is a block diagram depicting exemplary contents housed within the tube 202. The tube 202 preferably comprises the containing blanket 300 made of an explosive-resistant material, e.g., Kevlar®, capable of withstanding the explosion. In addition, the tube 202 comprises at least one thruster 1003. The thruster 1003 may be of any type of thruster known or future-developed. A thruster 1003 may employ electrothermal propulsion, which refers to acceleration of a propellant gas by electrical heat addition and expansion through a convergent/divergent nozzle, e.g., resistojets or arcjets. The thruster 1003 may further employ electrostatic propulsion, which refers to acceleration of an ionized propellant gas by the application of electric fields, e.g., gridded ion thrusters, colloid thrusters, and field emission electric propulsion. The thruster 1003 may employ electromagnetic propulsion, which refers to acceleration of an ionized propellant gas by the application of both electric and magnetic fields, e.g., Hall thrusters, pulsed plasma thrusters (PPT), and magnetoplasmadynamic thrusters. Other types of known or future-developed thrusters are possible.

The tube 202 further houses a tube controller 1005 and a separation device 1009. Within the tube 202, the thruster 1003 is attached to the containing blanket 300, which is described in more detail with reference to FIG. 11.

The tube controller 1005 comprises a receiver 1030 and a timing device 1001. In one embodiment, the tube controller 1005 receives control values indicative of projectile data and tube launch data, i.e., data defining when the tube 202 was launched, at what velocity, and coordinates describing the direction of the launched tube 202. Therefore, the tube controller 1005 can use such data to determine when to effectuate separation of the tube 202 via the separation device 1009. As indicated herein, the separation device 1009 may include an explosive or a mechanical device for releasing the tube 202 at fastener points 910.

Further, the tube controller 1005 can use such data to determine a value indicative of an elapsed time for activation of the thruster 1003 and/or release of the parachute 700 (FIG. 7) in order to ensure that the projectile is intercepted. In this regard, the tube controller 1005 may transmit such values to a thruster controller 1012 prior to separation of the tube 202. In this regard, once the tube 202 has separated, the tube 202 and a portion of its contents, including the tube controller 1005 and the separation device 1009 are eliminated and/or destroyed.

Alternatively, the tube controller 1005 may employ the timing device 1001 in order to time detonation of the tube based upon the projectile data received either prior to launch from the launching system controller 232, via the receiver 1030 from the launching system 232, or as calculated by the tube controller 1005, as described herein.

If the launching system controller 232 (FIG. 2) on the earth's surface 240 (FIG. 2) calculates such values, the launching system controller 232 can transmit the calculated values to the tube controller 1005 prior to the tube's launch or wirelessly via the transmitter 230 (FIG. 2). In this regard, the tube 202 is communicatively coupled to the launcher 234 (FIG. 2) prior to deployment. Therefore, such values indicative of activation time of the containing blanket 300, activation of the thruster 1003, and deployment of the parachute 700 (FIG. 7) may be transmitted to the tube 202 prior to launch. In such an embodiment, the tube controller 1005 of the tube 202 may use the values in order to control separation of the tube 202 and deployment of the containing blanket 300. Further, the tube controller 1005 may transmit such data to the thruster controller 1012, and the thruster controller may use such data to activate the thruster 1003 or release the parachute 700 from a parachute container 1007, in an exemplary embodiment.

If the launching system controller 232 calculates the described values, then after launching the tube 202, the launching system controller 232 may transmit control signals to the tube 202, as described hereinabove, wirelessly via transmitter 230. In this regard, the tube controller 1005 may receive the transmitted signals via the receiver 1030 of the tube controller 1005. Upon receipt of the signal, the tube controller 1005 of the tube 202 activates the separation device 1009. Activation of the separation device 1009 deploys the containing blanket 300. As described hereinabove, the tube 202 breaks when the containing blanket 300 is deployed, and the containing blanket 300 begins to travel as indicated in FIGS. 2-7.

Once the containing blanket 300 is deployed, the thruster control logic 1012 then controls activation of the thruster 1003 and release of the parachute 700 from the parachute container 1007. The thruster controller 1012 may activate the thruster 1003, i.e., the thruster 1003 begins propelling the containing blanket 300 toward the projectile 204 in the direction indicated by the reference arrow 604 in FIG. 6 based upon data received from the tube controller 1005, i.e., the tube controller transmits thruster 1003 activation times prior to detonation of the tube 202, or based upon a sensing device 1013 on the thruster or sensing devices on the containing blanket 300. The use of sensing devices on the blanket is described further with reference to FIG. 11.

The sensing device 1013 may comprise a motion sensor, an accelerometer, which senses a change in velocity, or other type of sensor know in the art or future-developed that is capable of sensing a change in force upon the thruster 1003 resulting from contact of the containing blanket 300 with the projectile 204. The thruster controller 1012 interfaces with the sensing device 1013, and upon sensing that the projectile 204 is enveloped by the containing blanket 300, the thruster controller 1012 activates a parachute release device 1021 that releases the parachute 700 (FIG. 7) from the parachute container 1007.

In one embodiment, the thruster controller 1012 signals the parachute release device 1021 based upon at a predetermined time. Such predetermined time can be calculated by the launching system controller 232 and stored by the thruster controller 1012 prior to launch. Alternatively, the tube controller 1005 may calculate such a predetermined time and transmit such a value to the thruster controller 1012 prior to separation.

The tube controller 1012 can be implemented in software, hardware, or any combination thereof and can be stored and transported on any computer-readable medium, as described herein. The thruster controller 1012 preferably comprises one or more processors (not shown), such as a digital signal processor (DSP) or a central processing unit (CPU), for example, that communicate to and drive the other elements within the thruster controller 1012.

During operation, the thruster controller 1012 determines based upon data received from the tube controller 1005, the sensing device 1013 or other sensing devices on the containing blanket 300, described further herein, to activate the thruster 1003. Once the thruster is activated by the thruster controller 1012, the thruster 1003 travels in the direction of the reference arrow 604 (FIG. 6). In so traveling, the pull of the thruster 1003 causes the containing blanket 300 to close and envelop the projectile 204.

After a predetermined amount of time elapses after the thruster 1003 is activated, the control logic 1012 may then release the parachute 700. Alternatively, there may be sensors, as described herein with reference to FIG. 11 that signal the control logic 1012 when the containing blanket 300 has been pulled sufficiently to envelop the projectile 204. Thus, the thruster controller 1012 may release the parachute 700 upon a signal from such sensors, described with reference to FIG. 11.

The parachute 700 then quietly descends to the earth's surface 240 (FIG. 2) thereby placing the containing blanket 300 and its contents 204 on the ground. Notably, the containing blanket 300 is made up of a material sufficient to withstand an explosion, as described herein. Therefore, if the projectile 204 explodes upon impact with the containing blanket 300 and/or the earth's surface 240 or sometime in between, the containing blanket 300 with continue to contain the explosion and any debris that would have otherwise fallen to the earth's surface 240 if the explosion were not contained.

Figure 11:
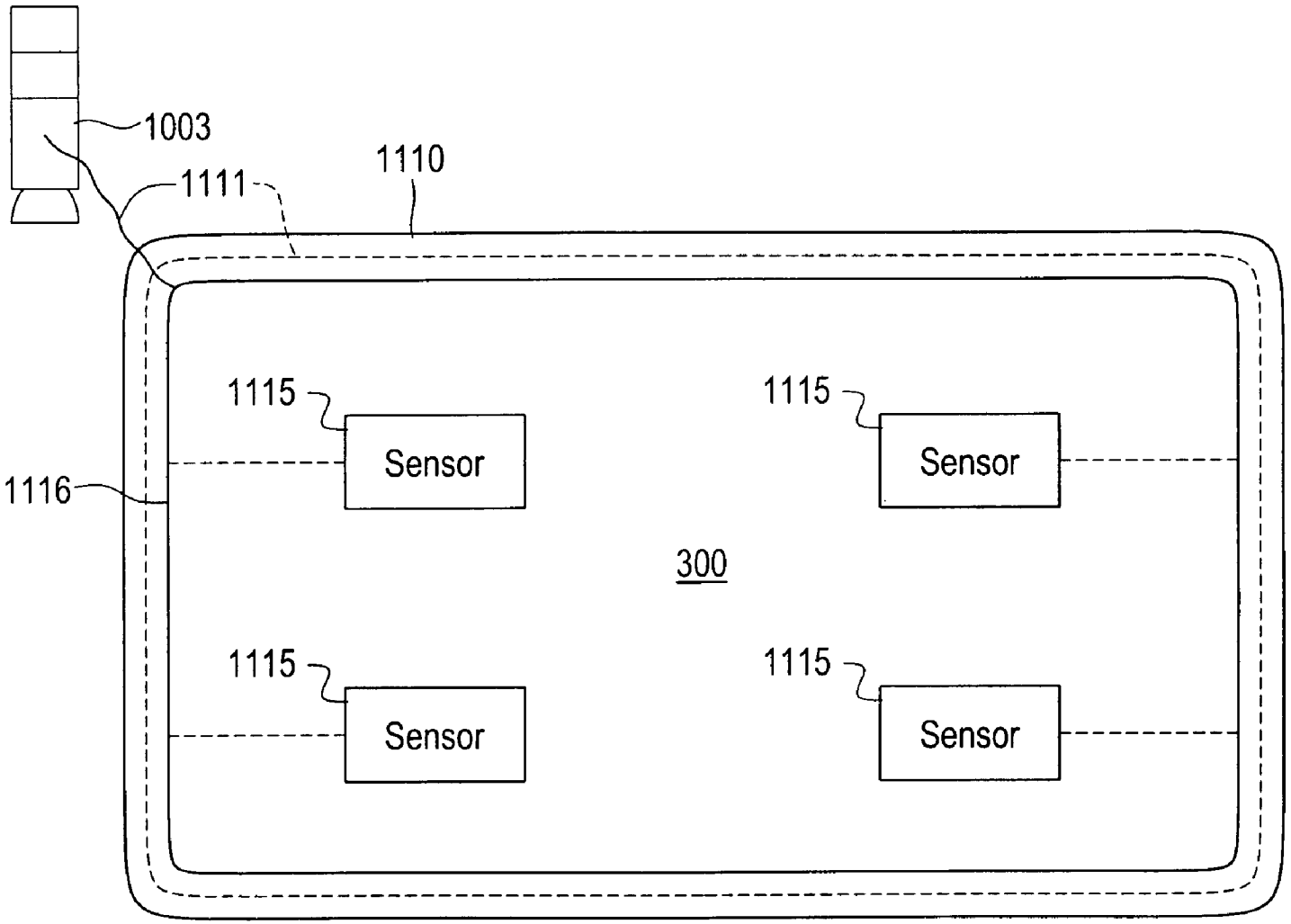
FIG. 11 depicts an exemplary blanket in accordance with FIG. 3.

The containing blanket 300 is now described with reference to FIG. 11. The containing blanket 300 preferably comprises at least one casing 1110. A "casing" refers to narrow passage made by folding over a small strip of material at its edge along its width and fastening it in place. The casing 1110 provides a channel through which a draw-wire 1111 is inserted. Note that the containing blanket 300 is preferably made of an explosion-resistant material, such as, for example Kevlar®. Furthermore, the draw-wire 1111 is further composed of a strong, yet flexible material which metal may be, for example.

In one embodiment the containing blanket 300 may comprise a plurality of sensors 1115 sewn into the fabric or otherwise attached to the containing blanket 300. Such sensors 1115 may be communicatively coupled to the thruster 1003, for example communicatively coupled to the thruster controller 1012 via a connection 1116. Such connection may comprise a wire that is sewn into an additional casing (not shown) in the containing blanket 300.

The containing blanket 300 is attached to the thruster 1003 via the draw-wire 1111. Therefore, when the thruster 1003 is activated, the thruster 1003 drives in a direction such that the draw-wire 1111 is pulled by the thruster 1003. When the thruster 1003 pulls the draw-wire 1111, the containing blanket 300 begins to deform as described with reference to FIGS. 2-7. Eventually, the draw-wire 1111 completely closes the containing blanket 300 upon the projectile 204. Note that the force of the projectile 204 in the direction of the vector 602 (FIG. 6) in combination with the force of the thruster 1003 pulling in the direction of the vector 604 (FIG. 6) pulls the draw-wire 1111, thereby closing the containing blanket 300.

In one exemplary embodiment, the thruster controller 1012 activates the thruster based upon data received from the sensing devices 1115 via the communication line 1116. Alternatively, the thruster controller 1012 may comprise a timer (not shown) and/or predetermined timer values or distance values, as described hereinabove, and the thruster controller 1012 activates the thruster 1003 based upon elapsed time determined by the timer and/or the predetermined values.

As described herein, the tube controller 1005, prior to separation of the tube 202, may provide data indicative of activation times of the thruster 1003 or the parachute release device 1021. Such data may be calculated by the tube controller 232 (FIG. 2) 1005, may be received via the receiver 1030 from the transmitter 230 (FIG. 2), or may be received from the launching system controller prior to launch of the tube 202.

Thus, in addition to calculating a value indicative of a launch time, the launching system controller 232 (FIG. 2) also calculates a value indicative of a blanket activation time and a parachute activation time based upon the projectile data received. In this regard, the projectile data received from a detection and/or tracking system, as described hereinabove, may comprise data, for example, indicative of the location of the projectile 204 at a particular time, i.e., its x-, y-, and z-coordinates, its velocity, the type of projectile 204, e.g., missile, RPG, etc, and/or other data further describing the projectile characteristics. The launching system controller 232 (FIG. 2) uses the projectile data received for determining and/or otherwise calculating values for intercepting the projectile 204. Such values may be calculated referenced from tube-deployment time.

Figure 12:
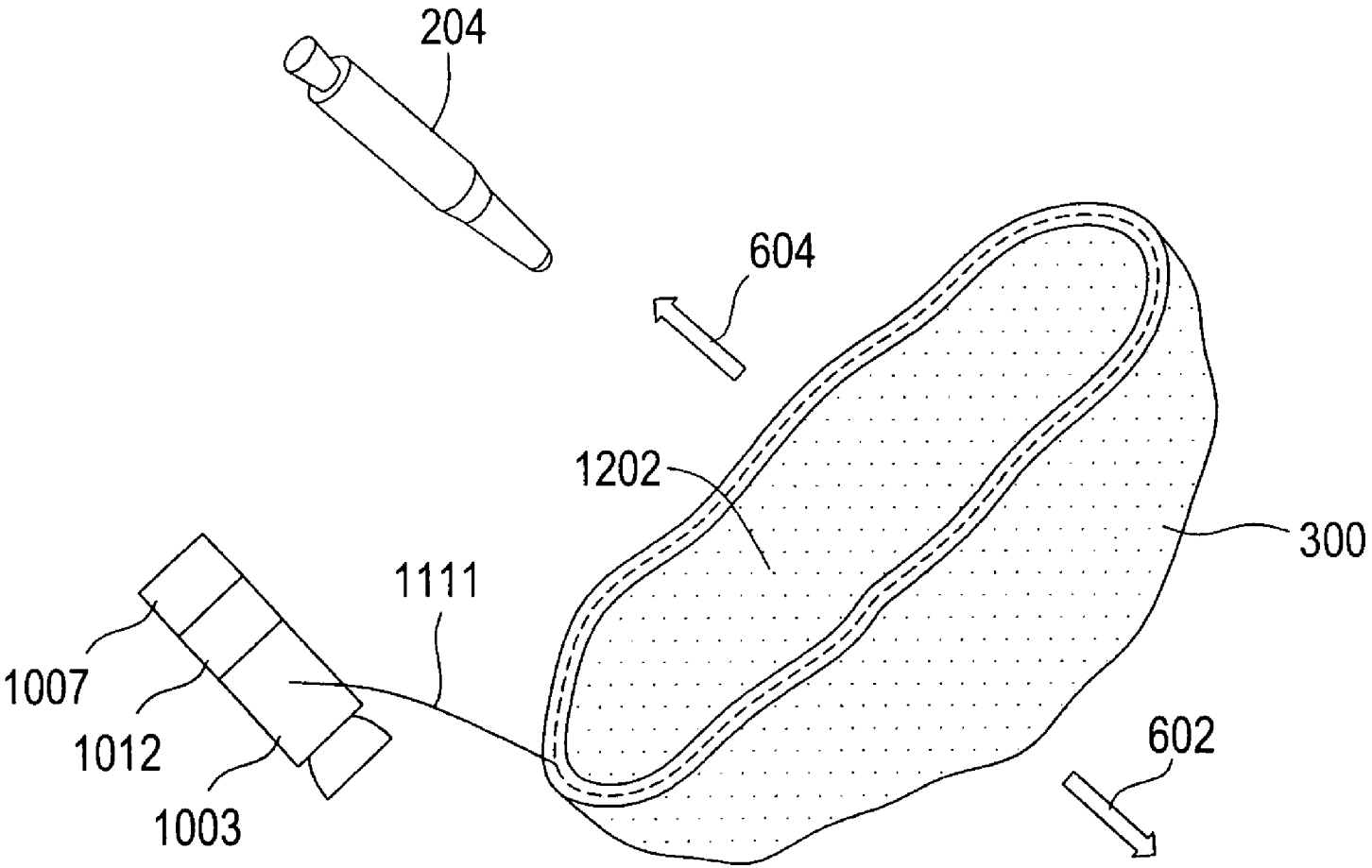
FIG. 12 depicts the blanket of FIG. 11 as it travels toward a projectile via a thruster in accordance with an embodiment of the present disclosure.
Figure 13:
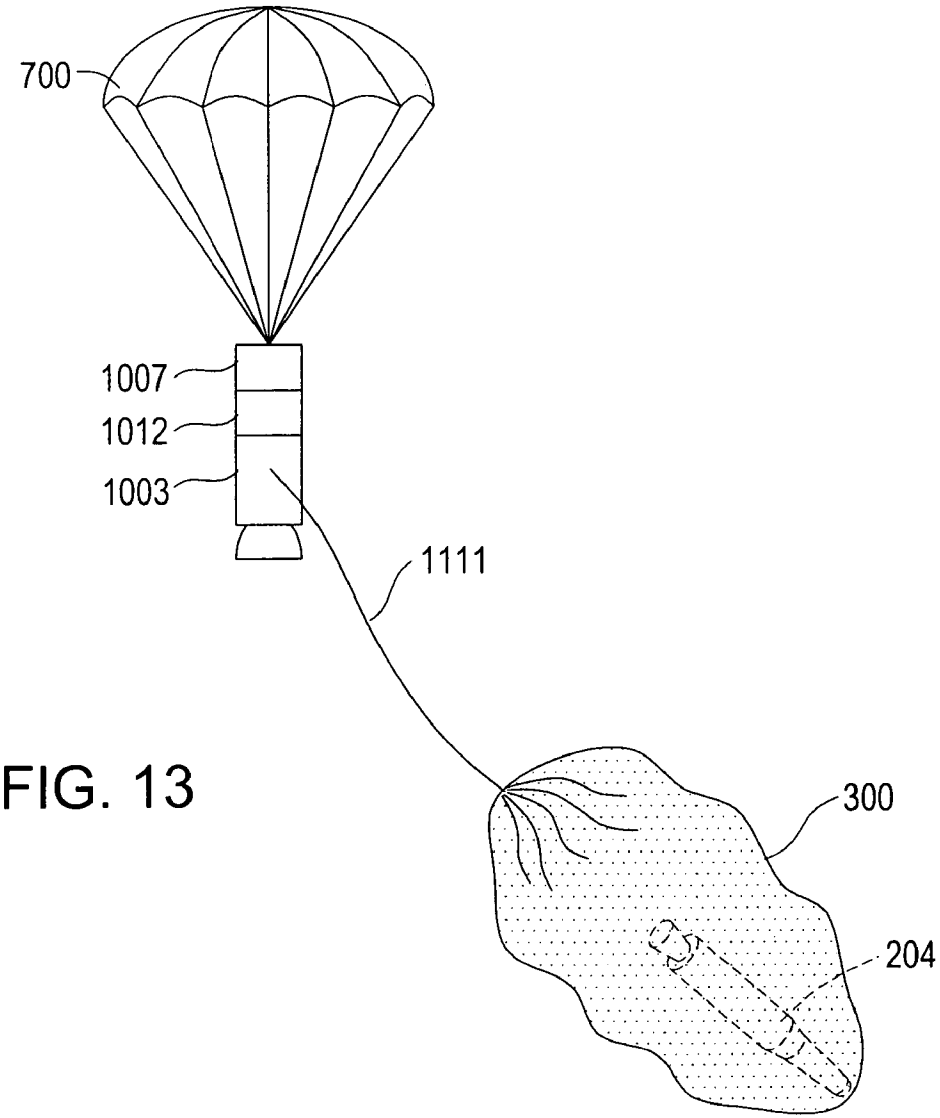
FIG. 13 depicts the envelopment of the projectile by the blanket of FIG. 11 in accordance with an embodiment of the present disclosure.

FIGS. 12 and 13 illustrate the containing blanket 300 enclosing a projectile 204 as the projectile 204 moves in the direction of reference arrow 602 and the thruster 1003 moves in the direction of the reference arrow 604 (FIG. 6). With reference to FIG. 12, the containing blanket 300 moves in the direction of reference arrow 602 as a result of the continued motion from the inertia of the separated tube 202. The mouth 1202 of the containing blanket 300 formed by the draw-wire 1111 is formed so that a precisely aligned capture is unnecessary with respect to the incoming projectile 204. As the containing blanket 300 moves in the direction of arrow 604, the thruster 1003 moves with the containing blanket 300 in the same direction. In this regard, the thruster 300 is preferably inactive until sensing of the projectile 204 by the containing blanket 300 via the sensing devices 1115 or 1013. Once the projectile 204 is detected, the thruster controller 1012 activates the thruster 1003 thereby pulling the draw-wire 1111 so that the containing blanket 300 closes on the projectile 204.

With reference to FIG. 13, after the sensors detect the impact of the containing blanket 300 with the target 204, the thruster controller 1012 activates the parachute release device 1021 (FIG. 10), and the parachute container 1007 releases the parachute 700 (FIG. 7). The parachute 700 slowly brings the projectile 204 to the earth's surface 240 (FIG. 2).

Activation of the parachute 700 may be based upon, for example, a predetermined amount of elapsed time. Additionally, activation of the parachute 700 may also be based upon the sensing device 1013 (FIG. 10) or sensing devices 1115 (FIG. 11) detecting that the projectile is completely enclosed in the containing blanket 300.

Figure 14:
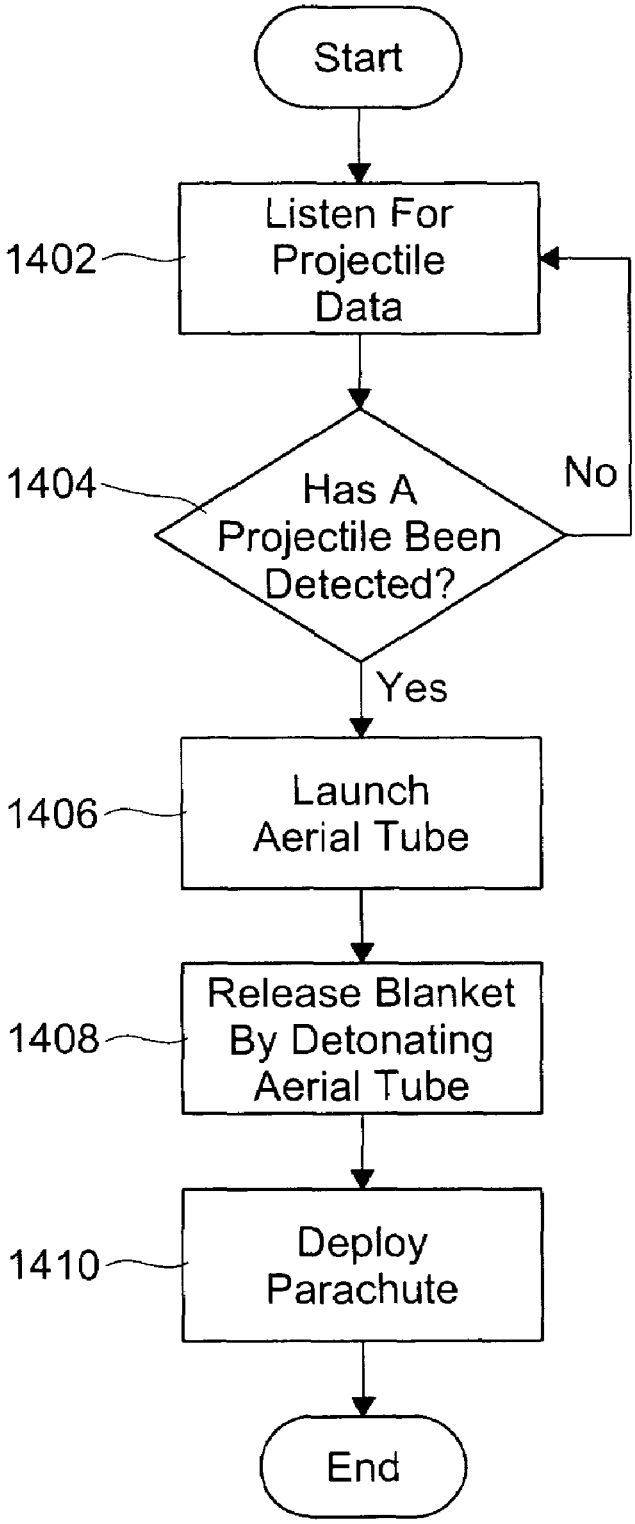
FIG. 14 depicts an exemplary architecture and functionality of the system of the present disclosure.

FIG. 14 depicts and exemplary architecture and functionality of the system of the present disclosure.

The launching system 200 listens for received projectile data in step 1402. If an incoming projectile 204 is detected in step 1404, then the launching system 200 launches an aerial tube 202 (FIG. 2) in step 1406.

Note that as described herein, the incoming projectile 204 can be detected in a number of ways. For example, a ground-based radar system 214 might detect the projectile 204 and transmit projectile data to the system 200. Additionally, an early warning system 212 may transmit projectile data to the system 200.

Once the tube 202 is launched, the containing blanket 300 is released by detonating the aerial tube 202, as indicated in step 1408. Detonation may be controlled remotely from the ground by the launching system 200 or it may be controlled by the tube controller 1005 (FIG. 10).

One the containing blanket 300 is released, the blanket travels by inertia or via a thruster 1003, for example until it contacts the incoming projectile 204. The parachute 700 (FIG. 7) is then deployed in step 1410.

Figure 15:
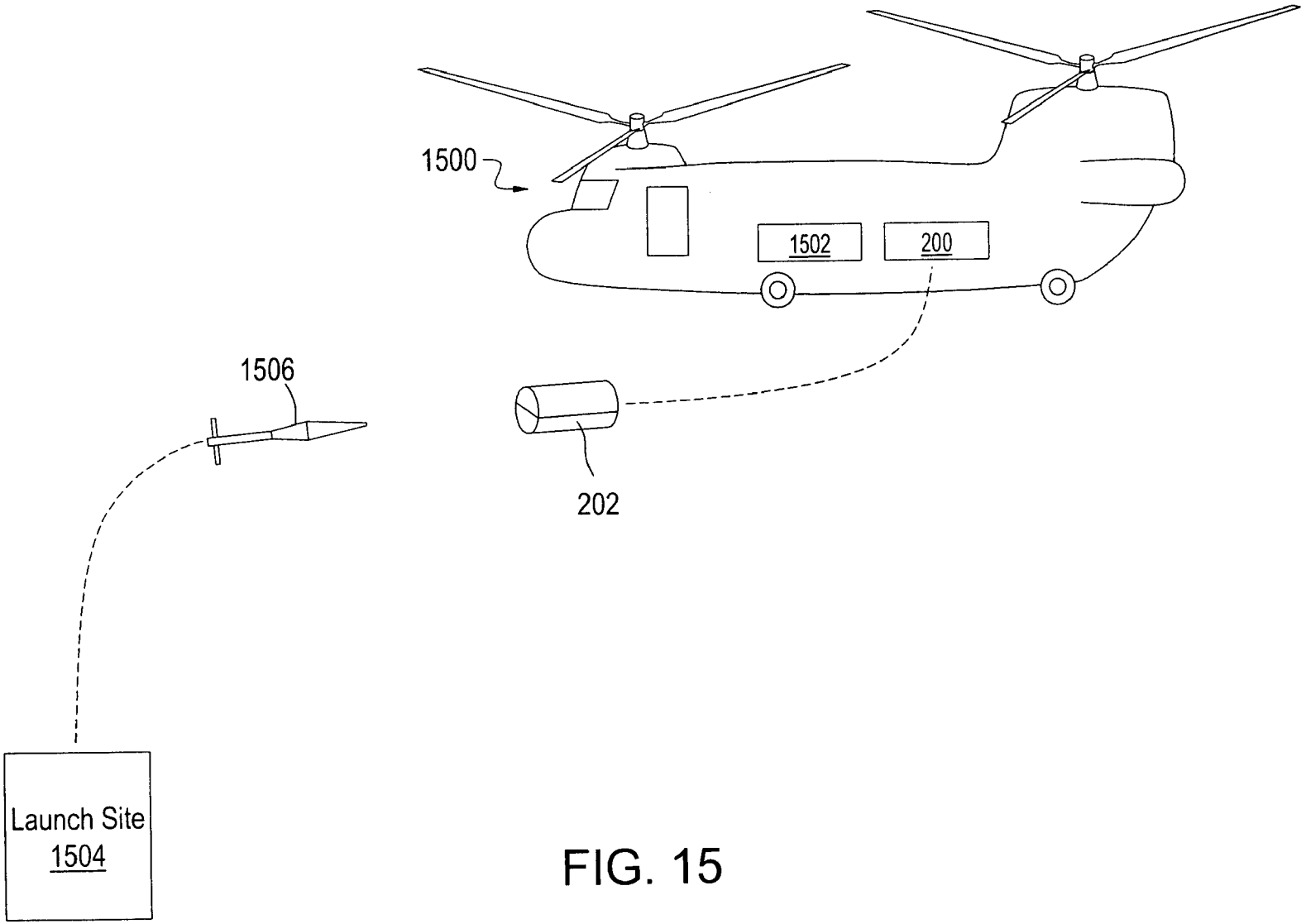
FIG. 15 is a diagram illustrating another embodiment of a projectile interception system of the present disclosure.

In another embodiment of the launching system 200 of the present disclosure, the launching system 200 is installed on a helicopter 1500 as depicted in FIG. 15. In this regard, an on-board detection system 1502 detects an incoming projectile 1506 from a launch site 1504. For example, the projectile 1506 may be a rocket-propelled grenade or shoulder-fired missile. Upon detection, the detection system 1502 transmits projectile data to the launching system 200. The launching system 200 launches an aerial tube 202 for intercepting the projectile 1506.

Figure 16:
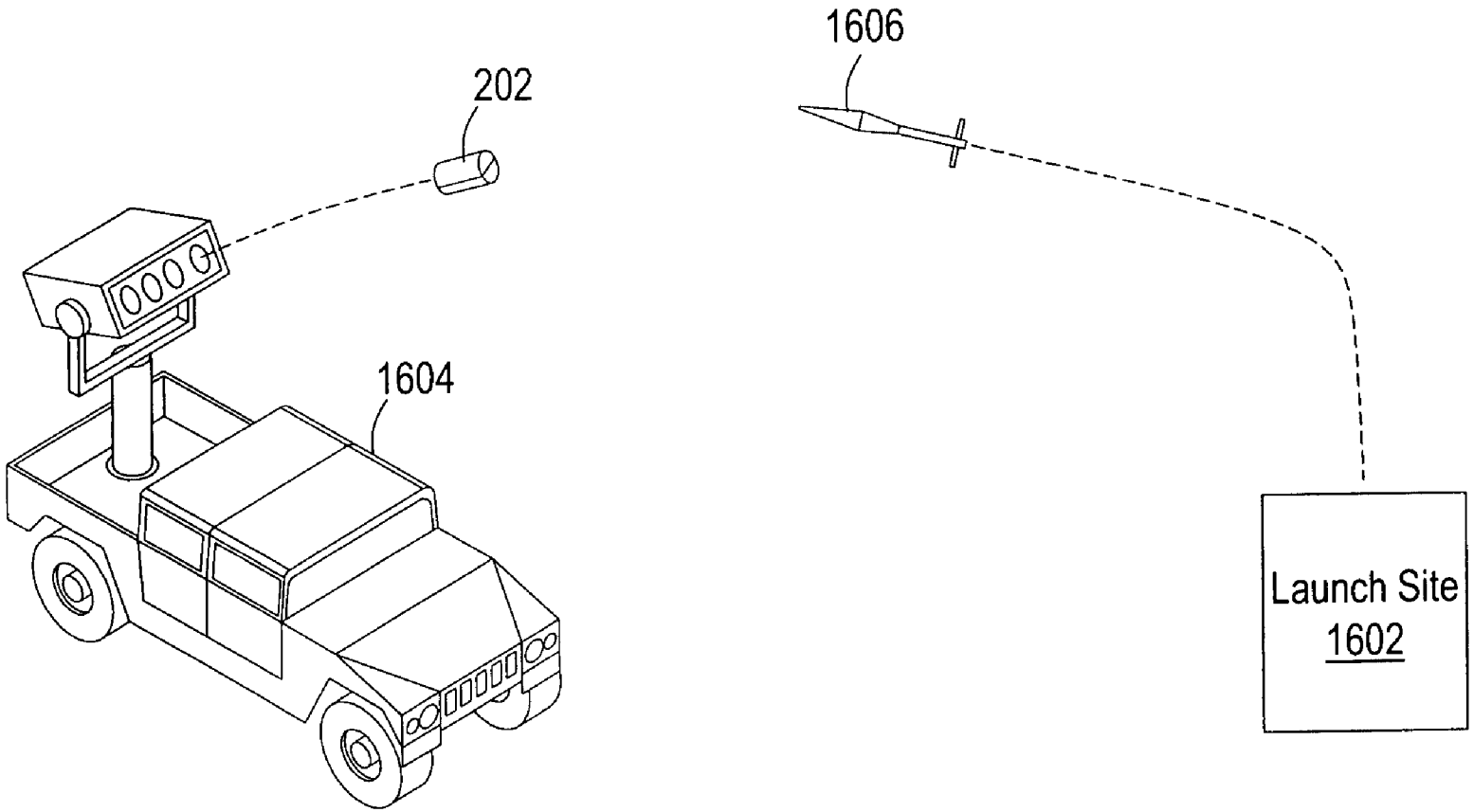
FIG. 16 is a diagram illustrating another embodiment of a projectile interception system of the present disclosure.

In another embodiment, the launching device 234 of the present disclosure is installed on a high mobility multipurpose-wheeled vehicle (HMMWV) 1604 as depicted in FIG. 16. In this regard, an on-board detection system (not shown) detects an incoming projectile 1606 from a launch site 1602. For example, the projectile 1606 may be a rocket-propelled grenade. Upon detection, the launching device 234 launches an aerial tube 202 for intercepting the projectile 1606.

The invention claimed is:

1. A system, comprising:

a containment blanket;

a launcher configured to launch the containment blanket to intercept a projectile;

a parachute attached to the containment blanket;

a thruster attached to the containment blanket;

a sensor sewn into the containment blanket, the sensor configured to sense collision of the containment blanket with the projectile; and at least one controller configured to deploy the containment blanket such that the containment blanket envelops the projectile, the at least one controller further configured to activate the thruster based on the sensor after the sensed collision and to activate the parachute after the activation of the thruster.

2. The system of claim 1, wherein the at least one controller is further configured to activate the parachute after the containment blanket envelops the projectile.

3. The system of claim 2, wherein the containment blanket comprises a draw-wire for closing the containment blanket.

4. The system of claim 3, wherein the draw-wire is attached to the thruster.

5. The system of claim 4, wherein the thruster is configured to pull the draw-wire so that the blanket closes around the projectile.

6. The system of claim 1, wherein the blanket is composed of an explosive resistant material.

7. The system of claim 1, wherein the containment blanket is housed in a tube.

8. The system of claim 1, further comprising a timer, wherein the at least one controller is configured to activate the thruster based on the timer.

9. The system of claim 1, further comprising a timer, wherein the at least one controller is configured to activate the parachute based on the timer.

10. A system, comprising:

a containment blanket, wherein the containment blanket is housed in a tube;

a launcher configured to launch the containment blanket to intercept a projectile;

a parachute attached to the containment blanket;

a thruster attached to the containment blanket;

a sensor attached to the containment blanket, the sensor configured to sense collision of the containment blanket with the projectile;

at least one controller configured to deploy the containment blanket such that the containment blanket envelops the projectile, the at least one controller further configured to activate the thruster based on the sensor after the sensed collision and to activate the parachute after the activation of the thruster; and a separation device configured to separate the tube, wherein the at least one controller is configured to activate the separation device in response to a wireless signal received from a remote device.

11. A system, comprising:

a containment blanket, wherein the containment blanket is housed in a tube;

a launcher configured to launch the containment blanket to intercept a projectile;

a parachute attached to the containment blanket;

a sensor attached to the containment blanket, the sensor configured to sense collision of the containment blanket with the projectile;

at least one controller configured to deploy the containment blanket such that the containment blanket envelops the projectile, the at least one controller further configured to activate the thruster based on the sensor after the sensed collision and to activate the parachute after activation of the thruster;

a separation device configured to separate the tube; and a timer, wherein the at least one controller is configured to activate the separation device based on the timer.

12. A system, comprising:

a containment blanket;

a parachute attached to the containment blanket;

a thruster attached to the containment blanket;

a sensor sewn into the containment blanket, the sensor configured to sense collision of the containment blanket with a projectile; and at least one controller configured to control the system such that the containment blanket intercepts the projectile, the at least one controller further configured to activate the thruster based on the sensor after the sensed collision and to activate the parachute after activation of the thruster.

13. The system of claim 12, further comprising a timer, wherein the at least one controller is configured to activate the thruster based on the timer.

14. The system of claim 12, further comprising a timer, wherein the at least one controller is configured to activate the parachute based on the timer.

15. A system, comprising:

a containment blanket;

a parachute attached to the containment blanket;

a thruster attached to the containment blanket;

a sensor attached to the containment blanket, the sensor configured to sense collision of the containment blanket with a projectile;

at least one controller configured to control the system such that the containment blanket intercepts the projectile, the at least one controller further configured to activate the thruster based on the sensor after the sensed collision and to activate the parachute after activation of the thruster; and a tube, wherein the containment blanket is positioned in the tube;

a separation device configured to separate the tube; and a timer, wherein the at least one controller is configured to activate the separation device based on the timer.

16. A system, comprising:

a containment blanket;

a parachute attached to the containment blanket;

a thruster attached to the containment blanket;

a sensor attached to the containment blanket, the sensor configured to sense collision of the containment blanket with a projectile;

at least one controller configured to control the system such that the containment blanket intercepts the projectile, the at least one controller further configured to activate the thruster based on the sensor after the sensed collision and to activate the parachute after activation of the thruster;

a tube, wherein the containment blanket is positioned in the tube; and a timer, wherein the at least one controller is configured to activate the separation device based on the timer.

* * * * *